United States Patent [19]

Bocker

[11] Patent Number: 4,550,806

[45] Date of Patent: Nov. 5, 1985

[54] ELEVATING APPARATUS

[75] Inventor: Albert Bocker, Werne, Fed. Rep. of Germany

[73] Assignee: Albert Bocker GmbH & Co. KG, Fed. Rep. of Germany

[21] Appl. No.: 503,288

[22] Filed: Jun. 10, 1983

[30] Foreign Application Priority Data

Jun. 16, 1982 [DE] Fed. Rep. of Germany ..... 3222508

[51] Int. Cl.[4] ..... B66B 9/20

[52] U.S. Cl. ..... 187/10; 182/103

[58] Field of Search ..... 187/10, 11, 12–14, 187/6, 81, 87; 182/103, 101, 102, 141, 208, 166, 168; 105/157 R, 182 R

[56] References Cited

U.S. PATENT DOCUMENTS

| | | | |
|---|---|---|---|
| 156,541 | 11/1874 | Conrad et al. | 187/10 |
| 2,323,041 | 6/1943 | Honig | 187/14 |
| 2,660,263 | 11/1953 | Raddets et al. | 187/10 |
| 3,891,062 | 6/1975 | Geneste | 187/11 |
| 4,257,491 | 3/1981 | Presnall, Jr. et al. | 187/6 |

FOREIGN PATENT DOCUMENTS

| | | | |
|---|---|---|---|
| 779238 | 11/1980 | U.S.S.R. | 187/12 |

*Primary Examiner*—Joseph J. Rolla
*Assistant Examiner*—Kenneth Noland
*Attorney, Agent, or Firm*—George A. Evans

[57] ABSTRACT

An elevating apparatus comprises an inclined elevator and a load-carrying carriage. The inclined elevator comprises a pair of guide rails, and the carriage is movable along the guide rails by means of a cable. The carriage is movable along the guide rails on rollers provided on rocker arms pivotally mounted on the carriage. The upper portion of each guide rail is angled away from the remaining portion of that guide rail, the upper portions of the guide rails defining a horizontal section of the elevator which constitutes a discharge position for the carriage.

6 Claims, 6 Drawing Figures

FIG.1
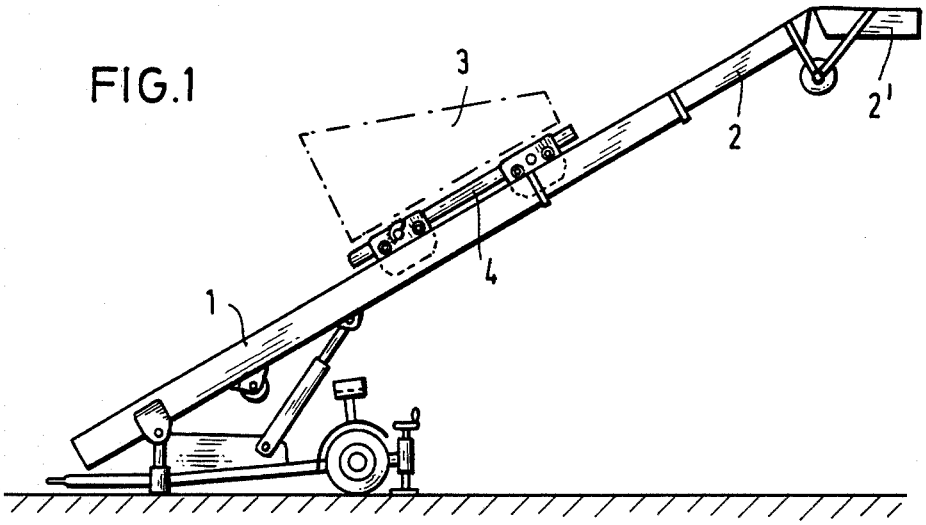
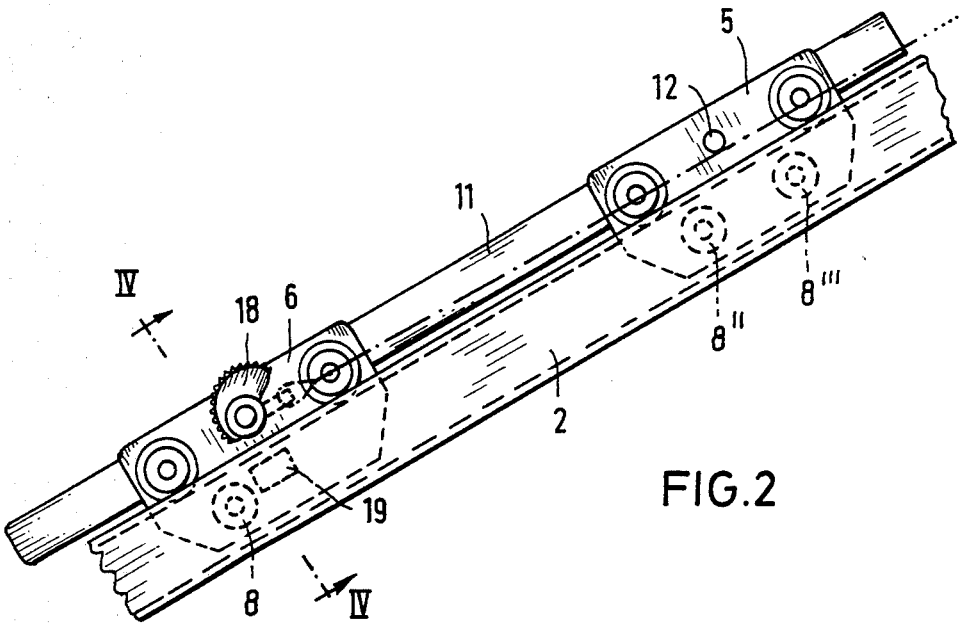
FIG.2

FIG.3
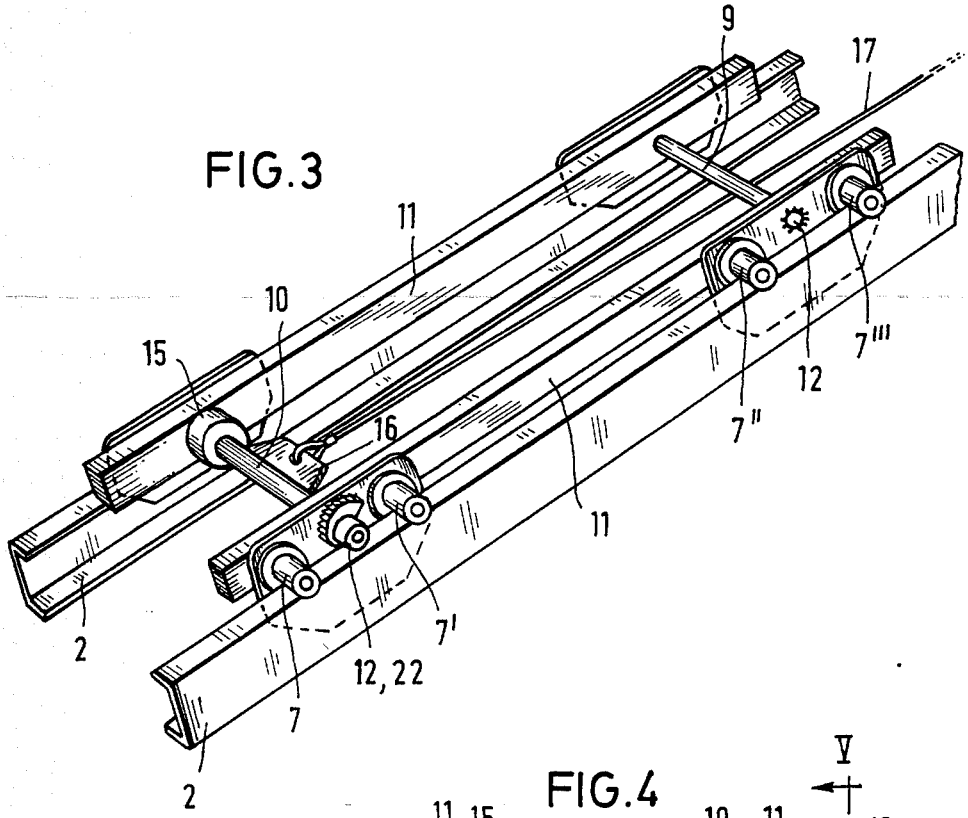
FIG.4
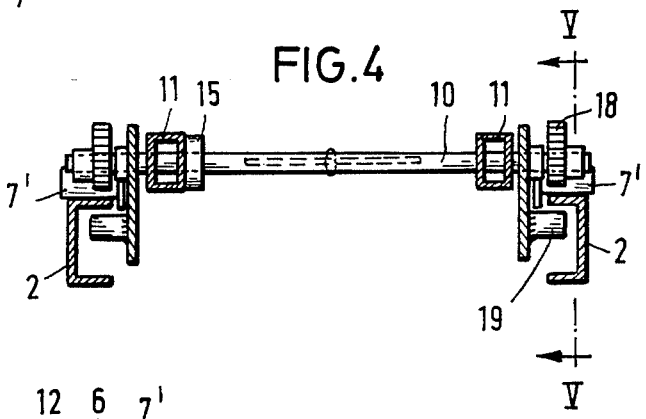
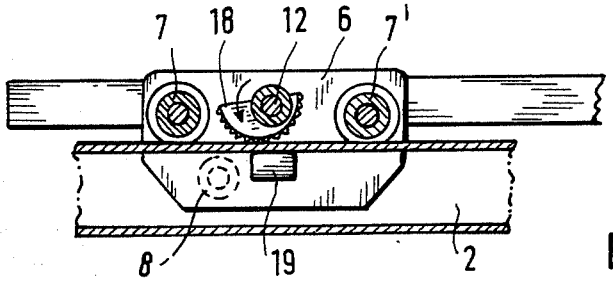
FIG.5

ELEVATING APPARATUS

BACKGROUND OF THE INVENTION

This invention relates to an inclined elevator and a carriage therefor, and in particular to an inclined elevator having a pair of laterally-spaced guide rails along which a carriage carrying a load can be moved with the aid of a cable.

Such inclined elevators with cable-drawn tub carriages are known. They are used for conveying a wide variety of materials. In the field of building construction, for example, such inclined elevators are used for conveying material and equipment. The carriages for the load tubs run on upwardly-inclined guide rails. With known elevators of this type, difficulties arise in carrying the material as far as possible into an accessible area in the discharge zone. In other words, the goods arriving at the upper end of such an elevator can be reached only with difficulty by the operating personnel. The known designs of carriage do not permit the carriage to be moved, in a relatively simple manner, towards the discharge zone, this movement being mainly in the horizontal direction.

The object of the present invention is, therefore, to provide an improved inclined elevator (and carriage therefor) which enables loaded material to be removed more easily in the upper discharge zone, by bringing the carriage into a more favourable unloading position without involving any appreciable increase in cost.

SUMMARY OF THE INVENTION

The present invention provides in an elevating apparatus comprising an inclined elevator and a load-carrying carriage, the inclined elevator comprising a pair of guide rails, and the carriage being movable along the guide rails by means of a cable, the improvements comprising movably mounting the carriage on the guide rails by means of rollers, and mounting the rollers on rocker arms provided on the carriage.

Preferably, the carriage has a chassis and two pairs of rocker arms. This special mounting of the rollers on the rocker arms enables the chassis of the carriage to adapt itself to the poriton of the guide rails that deviates from an inclined straight line. In practice, this means that the chassis of the carriage is able to follow a curved or angled portion of the guide rails, without interruption of positive mechanical support of the load on the guide rails by way of the rollers, that is to say increased surface pressure and, therefore, increased wear do not occur.

Each of the rocker arms may be provided with a pair of upper rollers. Advantageously, each of the rocker arms is pivotally mounted on the chassis of the carriage about a pivot axis. In this case, each of the rocker arms may be pivotally mounted on the chassis of the carriage about a pivot axis which lies between the two upper rollers of that rocker arm. This arrangement ensures that, when angled rail junctions are being negotiated, the upper rollers transmit the load in a reliable manner.

In a preferred embodiment, the carriage has a pair of axles, the free end of each of the axles being associated with a respective rocker arm. Advantageously, the chassis of the carriage comprises a pair of side plates, the side plates supporting the end portions of the axles. Preferably, each of the free ends of each axle forms a pivot shaft for the associated rocker arm.

Since it generally suffices if only the rocker arm, disposed forwardly in the direction of elevation, passes over an angled zone of the guide rails, whereas the rear rocker arm remains in the zone of the upwardly-inclined guide rails, then the rocker arms may be provided with differing roller arrangements. Preferably, the rocker arms of one pair of rocker arms (the front pair of rocker arms) each has two upper rollers and two lower rollers, said upper rollers engaging the upper surfaces of the respective guide rail, and said lower rollers engaging the lower surface of the respective guide rail, and wherein the axes of said lower rollers lie between the axes of said upper rollers; and the rocker arms of the other pair of rocker arms each has two upper rollers and one lower roller, said upper rollers engaging the upper surface of the respective guide rail, and said lower roller engaging the lower surface of the respective guide rail, the axis of said lower roller being positioned between the pivot axis of said rocker arm and the axis of the upper roller of that rocker arm which is remote from the rocker arms of said one pair of rocker arms. This form of construction ensures that the angled zone is negotiated in a reliable manner, that is to say each forward lower roller of the front pair of rocker arms is engaged in the angled portion of a guide rail, and prevents the load from lifting; whereas each rear lower roller of the front pair of rocker arms is still located in the zone of the corresponding upwardly-inclined guide rail of the inclined elevator. Moreover, the lower roller of each of the rear rocker arms sufficies to prevent the rear portion of the carriage from lifting.

In a preferred embodiment, the carriage further comprises a brake, said brake being associated with one of the axles and being operably connected to said cable. Preferably, the brake has a pair of eccentric brake elements pivotally mounted on said pivot shafts, and the axle is provided with a bracket which is connected to said cable. In this arrangement, said axle, the pivot shafts of the associated rocker arms, and the pivot shafts of the eccentric brake elements are arranged coaxially.

Advantageously, the brake elements are spring biassed towards a "brake-on" position, and the bracket is movably by said cable to move the brake element away from the "brake-on" position. The bracket also serves for releasing the spring-loaded eccentric brake elements. This means that, when the cable pulls the carriage up the inclined elevator, the spring-loaded brake is released; whereas, when the cable is relieved of load (as a result, for example, of its breaking), the brake is automatically applied because of the spring-loading. Preferably, a respective brake shoe is associated with each of the brake elements, each of the brake shoes bearing against the lower surface of the respective guide rail when the corresponding brake element is moved into engagement with the upper surface of that guide rail in the "brake-on" position.

It is also possible to provide spring-loaded brake elements at the free ends of both axles.

Although the construction and arrangement of the rocker arms are mainly intended to facilitate guiding of the carriage on the guide rails, and to contribute towards evening out of the surface pressure, they are particularly advantageous in the case where the inclined elevator has angled or curved guide rails. Thus, a feature of special importance is that, in the case of an inclined elevator of the initially stated kind, its guide rails are angled in the zone where the carriage is unloaded, and the deflected portions of guide rail are of such length that, in its discharging position, the carriage bears on preferably horizontally-extending portions of the guide rails by way of the forward rocker arms, and bears against the upwardly-inclined portions of the guide rails by way of its rear rocker arms.

BRIEF DESCRIPTION OF THE DRAWINGS

An inclined elevator and carriage therefor, each of which is constructed in accordance with the invention will now be described, by way of example, with reference to the accompanying drawings, in which:

FIG. 1 is a side elevation of the inclined elevator and the carriage;

FIG. 2 is an enlarged side elevation of the carriage;

FIG. 3 is a perspective view of the carriage;

FIG. 4 is a cross-section taken on the line IV—IV of FIG. 2;

FIG. 5 is a cross-section taken on the line V—V of FIG. 4, and shows the brake of the carriage in its operative position.

DESCRIPTION OF PREFERRED EMBODIMENT

Figure 6:
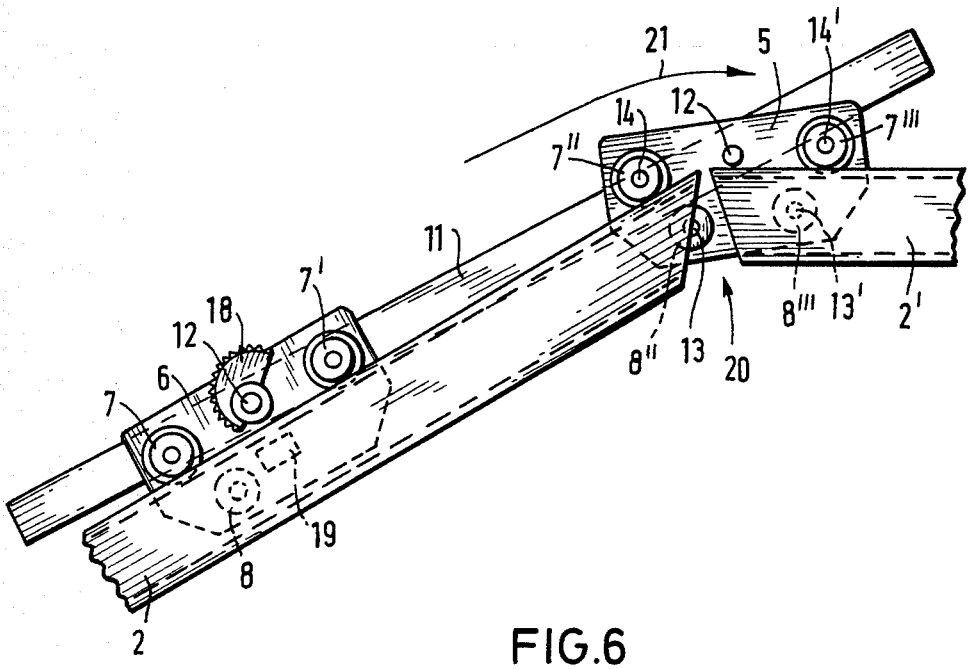
FIG. 6 is a side elevation of the elevator and the carriage, and shows the carriage negotiating an angled portion of the elevator.

Referring to the drawings, FIG. 1 shows an inclined elevator, indicated generally by the reference numeral 1. The elevator 1 is constituted by a plurality of telescoped sections. The elevator 1 has a pair of laterally-spaced guide rails 2, along which a load tub 3 can be moved on a carriage 4. The top of the elevator 1 is constituted by a top section having a pair of short guide rails 2'. This top section is pivotally attached to the upper end of the main section of the elevator 1, so that the top section can be horizontally disposed when the main section is inclined (as shown in FIG. 1). In this position, the adjacent portions of the main section and the horizontal top section of the elevator 1 define an angled zone 20. FIG. 1 shows the load tube 3 at a point half-way along the inclined elevator 1.

Referring to FIGS. 2 and 3, the carriage 4 comprises a chassis constituted by two side plates 11, two support axles 9 and 10 which interconnect the side plates 11, and two pairs of rocker arms 5 and 6. The rocker arms 5 are associated with the support axle 9, and the rocker arms 6 are associated with the support axle 10. The rocker arms 5 and 6 are mounted on their respective support axles 9 and 10, that is to say the pivot shafts 12 of the rocker arms 5 and 6 are constituted by the end portions of the axles 9 and 10 respectively. It is, however, also possible for the rocker arms 5 and 6 to have separate pivot shafts 12 which are offset from their respective support axles 9 and 10, and mounted on the two side plates 11.

Each of the rocker arms 5, which are disposed forwardly in the direction of elevation (indicated by the arrow 21 in FIG. 6), has two upper rollers 7'' and 7''' whereby it is guided on the guide rails 2. Each rocker arm 5 also has two lower rollers 8'' and 8''' (see FIG. 6), which are so arranged that their shafts 13 and 13' are disposed between the shafts 14 and 14' of the upper rollers 7'' and 7'''. As can be seen from FIG. 6, this arrangement ensures that, when the carriage 4 is negotiating the angled portion of the guide rails 2 and 2', the forward lower rollers 8''' are prevented from lifting by the horizontal rails 2', while the rear lower rollers 8'' are still in the zone of the upwardly-inclined guide rails 2. A reverse sequence occurs, of course, when the carriage 4 travels in the opposite direction.

Each rear rocker arm 6 also has two upper rollers 7 and 7' but only one lower roller 8. The rocker arms 6 do not need a pair of lower rollers, since they are substantially relieved of pressure (as seen from below); so that, for each rocker arm 6, a single lower roller 8 simply performs a safety function whereby lifting is prevented.

An eccentric brake 15 is mounted above the guide rails 2, and is associated with the rear support axle 10. The eccentric brake 15 has a pair of eccentric brake elements 18 and a pair of brake shoes 19, each eccentric brake element being mounted on a respective pivot shaft 22 which coincides with a respective free end of the pivot shaft 12 of the rocker arms 6. Each of the eccentric brake elements 18 is located in the zone of one of the rear rocker arms 6 and above the associated guide rail 2 (or 2'). Similarly, each of the brake shoes 19 is positioned below the associated guide rail 2 (or 2'). The eccentric brake 15 is actuated by a cable 17 which is connected thereto by a bracket 16 fixed to the axle 10. The eccentric brake 15 is spring-loaded towards its braking position (see FIG. 5), in which the horizontal upper flanges 23 of each of the guide rails 2 (or 2') are frictionally clamped between the eccentrics 18 and the brake shoes 19. In order to release the brake 15, the cable 17 is tensioned. This causes the axle 10 to rotate against the biassing force of the spring, which in turn rotates the eccentric brake elements 18 out of engagement with the upper flanges 23.

It is of course possible, in the known manner, to provide a displacement device between the load tub 3 and the carriage 4, whereby the tub can be pivoted relatively to the carriage. With the type of rocker arms described above (and in conjunction with the means for enabling the angled zone 20 to be negotiated) it is, however, expedient to dispense with such additional displacement means, since the load tub 3 after passing over the angle zone, is automatically brought into a horizontal position by means of the front rocker arms 5; and, at the same time, it is moved horizontally over an adequate distance into a receiving or unloading zone.

I claim:

1. A load-carrying elevator having a first linear section inclined at a specified angle and a second linear section downwardly inclined from the higher end of the first section, a pair of spaced tracks located on said sections and forming guide rail extensions from one section to the other, a chassis arranged to travel along said tracks and movable by means of a cable, said chassis comprising spaced side plates, a pair of axles extending between said side plates spaced at intervals along the length of the chassis, rocker arms mounted on each of said axles and pivoted therewith, rollers mounted on said rocker arms engaging the underside of the tracks, and rollers mounted on said rocker arms at either side of the axle arranged to roll on the top surface of the tracks, the load on the carriage being distributed between the axle while the load on each axle is distributed between the rollers engaging the top of the track, the construction being such as to enable a smooth transition of the carriage from a position where both axles are over the first linear section of the elevator to one where one axle is over the first section and the other axle is over the second section of the elevator.

2. Apparatus as set forth in claim 1 in which the rocker arm on the axle which is forward on the chassis during its upward movement includes a pair of rollers each of which is arranged to engage the lower surface of the track as the chassis moves from the lower section of the elevator to the higher section.

3. Apparatus as set forth in claim 2 in which the rocker arm on the axle which is lower on the chassis during said upward movement consists of only one roller engaging the lower surface of the track.

4. Apparatus as set forth in claim 2 in which the lower rollers rotate on the axle disposed between the axes of the rollers engaging the upper surface of the track.

5. In combination with apparatus as set forth in claim 1, a pair of brake elements plivotally mounted on each end of one of said pivot axles, a bracket secured to said axle the outer portion of which is connected to said actuating cable, and springs biasing said brake elements toward a "brake-on" position engaging said rails when force is not applied to said lifting cable, the force required to cause said cable to move said chassis being sufficient to overcome the springs and release the brakes.

6. Apparatus as set forth in claim 5 including brake shoes associated with each of said brake elements, each of said brake shoes bearing against the lower surface of the respective guide rail when the corresponding brake element is moved into engagement with the upper surface of the guide rail in the "brake-on" position.

* * * * *